US007530300B2

(12) United States Patent
Hornstein

(10) Patent No.: US 7,530,300 B2
(45) Date of Patent: May 12, 2009

(54) HYDRAULIC DOUBLE RAM LIFTING PLATFORM

(76) Inventor: Roland Hornstein, Mahdgasse 34, Pfalzgrafenweiler (DE) 72285

( * ) Notice: Subject to any disclaimer, the term of this patent is extended or adjusted under 35 U.S.C. 154(b) by 270 days.

(21) Appl. No.: 10/595,452

(22) PCT Filed: Oct. 15, 2004

(86) PCT No.: PCT/DE2004/002293

§ 371 (c)(1),
(2), (4) Date: Apr. 20, 2006

(87) PCT Pub. No.: WO2005/040617

PCT Pub. Date: May 6, 2005

(65) Prior Publication Data

US 2006/0289239 A1 Dec. 28, 2006

(30) Foreign Application Priority Data

Oct. 22, 2003 (DE) ..... 103 49 065

(51) Int. Cl.
*F15B 11/072* (2006.01)
*B66F 7/20* (2006.01)

(52) U.S. Cl. ..... 91/4 R

(58) Field of Classification Search ..... 91/4 R; 187/215

See application file for complete search history.

(56) References Cited

U.S. PATENT DOCUMENTS

| | | | | |
|---|---|---|---|---|
| 1,725,302 | A * | 8/1929 | Riddle et al. | 187/215 |
| 1,919,156 | A * | 7/1933 | Banning | 92/77 |
| 2,339,086 | A * | 1/1944 | Makaroff | 60/414 |
| 2,637,302 | A | 5/1953 | Harrison et al. | |
| 2,802,457 | A * | 8/1957 | Thompson | 91/4 R |
| 3,693,500 | A | 9/1972 | Crandall et al. | |
| 4,452,340 | A | 6/1984 | Hernick et al. | |

* cited by examiner

*Primary Examiner*—F. Daniel Lopez
(74) *Attorney, Agent, or Firm*—Black Lowe & Graham, PLLC

(57) ABSTRACT

The invention relates to a hydraulic double ram lifting platform with two cylinder tubes (3), moving together in the vertical direction (17), a hydraulically-operated lifting unit (18), for each cylinder tube (3), a mechanical cross-support (5), for both lifting units (18) to ensure synchronization of both cylinder tubes (3) and rotational fixing about the longitudinal axis thereof, characterized in that each lifting unit (18) is provided with a standing, hollow plunger piston (4), supported at the base, within which compressed air (26) and a hydraulic fluid (27) are arranged, the interior of which is embodied as a pressurized reservoir and to the lower end of which a curved tube is fixed, which extends inside up to the upper reaches (22) of the plunger piston (4).

6 Claims, 3 Drawing Sheets

HYDRAULIC DOUBLE RAM LIFTING PLATFORM

TECHNICAL FIELD

The invention relates to a double-ram lifting platform, as used to lift motor vehicle lifting platforms in motor vehicle workshops. The double-ram lifting platform is installed underground in the floor of the workshop, so that in the retracted state only the motor vehicle holding means can be seen.

The vehicles can be lifted to different heights by means of the double-ram lifting platform, in order to provide easier access below the vehicle. A working trench below the vehicle therefore does not have to be provided.

PRIOR ART

Double-ram lifting platforms of the type mentioned above consist of two hydraulic cylinders which are arranged next to one another in the longitudinal direction of the vehicle, a device for ensuring synchronization of the two hydraulic cylinders, an anti-lowering means which prevents unintentional lowering of the two hydraulic cylinders, and a drive unit. They also comprise a lifting platform control system and holding supports for lifting the vehicle.

The hydraulic cylinders, the synchronization device, the anti-lowering means and often also the drive unit are installed in a waterproof installation bay.

The lifting platform control system is usually located on the front or side of the lifting platform working space. The two holding supports are screwed onto the extending parts of the hydraulic cylinder and rest on the floor of the workshop in the retracted state.

The use of installation bays has the advantage that most of the assembly of the parts and components can take place at the manufacturer's premises and thus a comprehensive check of function and quality can be carried out. The installation, mounting and commissioning of the lifting platform on site is considerably simplified and facilitated thereby.

Modern double-ram lifting platforms are designed as two-way cylinders. They operate in the so-called high-pressure range, that is to say the operating pressure is usually above 100 bar. In the two-way cylinder principle, the two piston rods—also referred to as plunger pistons—remain standing on the bottom of the installation bay. The cylinder tubes, which are provided with a smooth surface on the outside, move through guides which are screwed to the installation bay at the upper end. In this way, it is possible in a very simple manner to connect the two extending cylinder tubes to a single-part or multi-part transverse support. This single-part or multi-part transverse support ensures the synchronization of the two cylinder tubes and also prevents each of the two cylinder tubes from being able to rotate about its longitudinal axis.

The drive of the lifting platform is usually an electrohydraulic drive. Hydraulic oil is usually used as the hydraulic medium. Since hydraulic oil is a fluid which is hazardous to water, the installation bays are produced such that they are leaktight. In the event of any escaping hydraulic oil (e.g. due to sealing defects or leakages), the installation bay serves as a collecting chamber which has to be regularly monitored and checked for leaktightness in accordance with regional regulations. The installation bays used include those made of steel and those made of plastic. Those made of steel have the advantage that they are stable with regard to transport, but in the installed state are exposed to the risk of corrosion, which is problematic for environmental reasons when oil is used as the hydraulic medium. Those made of plastic are largely corrosion-resistant in the installed state. However, transport presents a considerable risk of damage and thus also a risk to the environment.

The drive unit of the lifting platform is usually equipped with an electric motor. The electric motor and possibly also the lifting platform control system has to be adapted to the local conditions—single-phase or three-phase network—and the available voltage supply.

Patent specification DE 198 24 08 1 C2 discloses a double-ram lifting platform of this type with two-way cylinders in an electrohydraulic design. The standing plunger pistons are made of a solid material, that is to say they are not designed to be hollow on the inside, for example as a tube. In particular, they do not serve to store the hydraulic fluid.

The disadvantages of the prior art are that electrical power is required to operate lifting platforms of this type, and oil is used as the hydraulic medium, which has environmentally hazardous properties. In lifting platforms of this type, designs are also known which are driven by compressed air. However, a so-called separate intermediate oil container is then required as the pressure vessel, in which the hydraulic fluid required for extension purposes is stored in the lowered state of the lifting platform. To lift the lifting platform, compressed air is fed into this pressure vessel and the hydraulic fluid required for the lifting volume is removed therefrom. This pressure vessel requires a relatively large volume and is difficult to accommodate.

Either it takes up space in the workshop or it has to be installed underground, which entails further costs and environmental risks. Moreover, pipes or hoses are required between the two lifting units and the intermediate oil container, through which the hydraulic fluid flows. These pipes or hoses are in turn exposed to corrosion and ageing and the laying thereof increases the installation time and installation costs.

Laid-open specification 1 431 975 discloses a pneumatic-hydraulic lifting unit in which the hydraulic fluid is stored within the lifting unit. The disadvantage of this prior art is that two seals are required for each lifting unit and no mechanical coupling to ensure synchronization can be fitted at the lower end of the extending part of the lifting unit when the lifting unit is to be used for example for a double-ram lifting platform.

German utility model DE 1 933 273 U discloses a pneumatic-hydraulic lifting cylinder in which the hydraulic fluid is accommodated in the extending plunger piston. The disadvantages of this prior art are that it is necessary that the control valve is located inside the plunger piston and that a movable control line is arranged inside the plunger piston for actuating the control valve. In this lifting cylinder, too, no mechanical coupling to ensure synchronization can be fitted at the lower end of the extending part of the lifting unit when the lifting unit is to be used for example for a double-ram lifting platform.

The object of the invention is to propose a pneumatic-hydraulic double-ram lifting platform which is safe and easy to use, requires less installation space and can be produced with reduced complexity and reduced costs. Based on the prior art, this object is achieved by the advantageous design of a novel pneumatic-hydraulic two-way cylinder.

BRIEF DESCRIPTION OF THE DRAWING

The invention will be described and explained in more detail below with reference to the example of embodiment shown in the drawing, in which.

SUMMARY OF THE INVENTION

Figure 1:
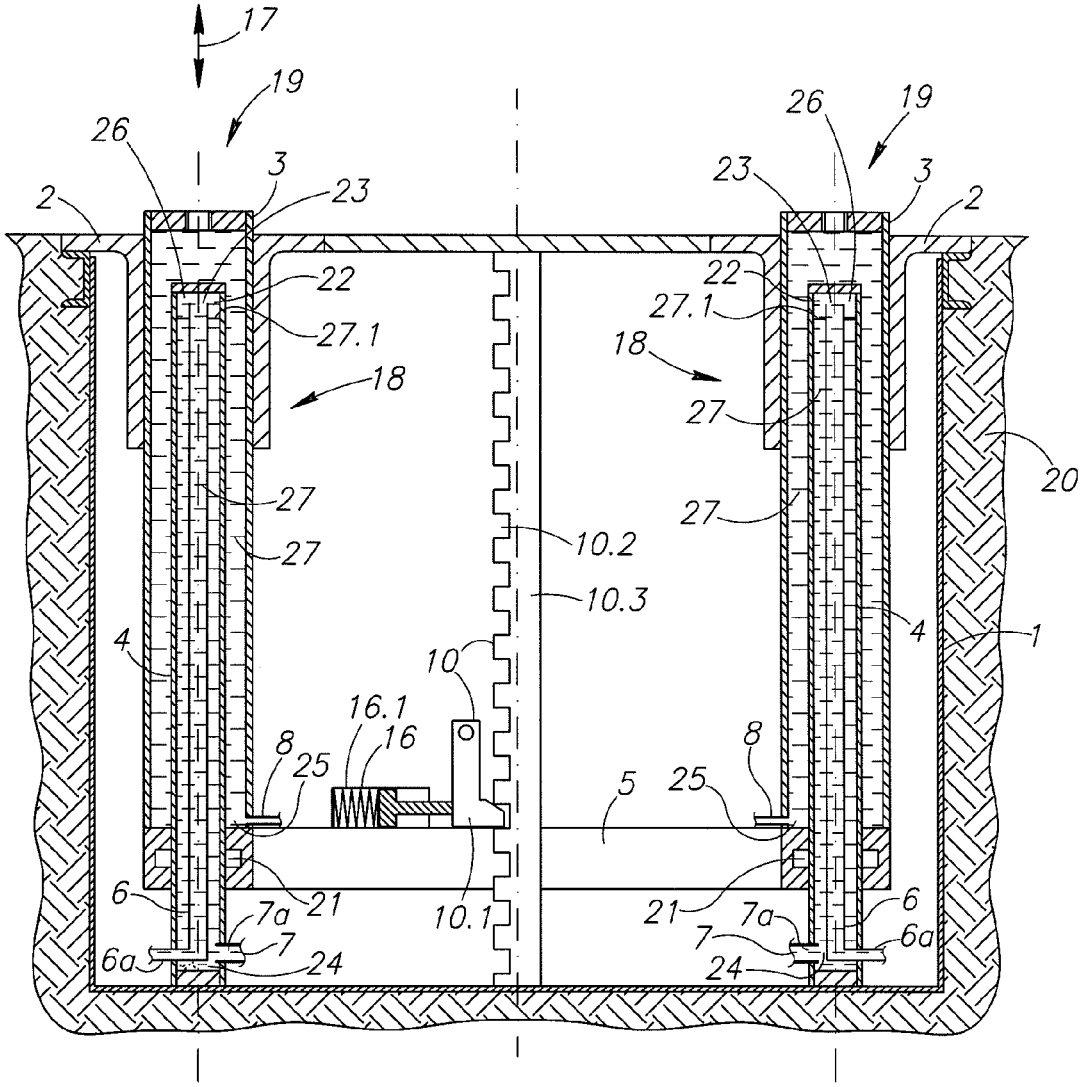
FIG. 1 shows a schematic, partially cut-away view of the lifting platform according to the invention in the almost completely lowered state.

Based on this prior art, the object of the invention is to provide a technically improved double-ram lifting platform of the type mentioned above. This invention is realized by the features of Claim 1.

The double-ram lifting platform according to the invention is characterized firstly in that it is driven pneumatically but nevertheless is operated fully hydraulically. Fully hydraulically in this case means that no compressed air is located in the interior of the two cylinder tubes—as in the case of electrohydraulic drive—but rather just the hydraulic fluid as medium. However, it is not driven oil-hydraulically and electrically, but rather water-hydraulically and pneumatically. Since use is not made of any hydraulic medium which is hazardous to water, all the environmental problems are omitted along with the associated protective and precautionary measures intended to prevent partial amounts of the hydraulic medium that is hazardous to water from escaping from the hydraulic circuit, and there is also no need for the installation bay to serve as a leaktight collecting chamber.

The same technical design of the lifting platform can be supplied and installed anywhere, regardless of any locally differing electrical power supplies. Since the lifting platform is actuated manually and the valves and safety devices are switched pneumatically, there is no need for any electrical power connections.

The requirements regarding the quality of the installation bay are reduced. It no longer has to monitored and checked for leaktightness.

The double-ram lifting platform according to the invention comprises an installation bay (1) which is installed underground and is filled in with earth, sand, gravel and lean concrete (20). Guides (2) are screwed in to both sides of the installation bay (19), through which guides the two cylinder tubes (3) extend and retract (17) hydraulically. At the lower end, the cylinder tubes (3) have an internal seal (21) with respect to the standing plunger pistons (4). The cylinder tubes (3) are coupled to one another at their lower end (25), below the connection possibility (8), by a single-part or multi-part transverse support (5), so that synchronization is obtained.

The plunger pistons (4) are hollow on the inside. At their lower end (24), a curved tube (6) is attached to the opening (6*a*). This curved tube (6) is located inside the plunger piston (4) and extends up to the uppermost region (22) of the plunger piston (4). This curved tube (6) is open at the top (23). Through this curved tube (6), compressed air (26) is passed into the uppermost region of the plunger piston (22). In the retracted state, the plunger pistons (4) are filled with hydraulic fluid (27), preferably with water, up to their upper region (22) and up to close to the upper opening (23) of the curved tube (6). Additives may be added to the hydraulic fluid, water (27), said additives being environmentally friendly, counteracting the development of noise and the formation of corrosion in respect of metallic materials and reducing friction in sliding bearings and seals. Instead of water, it is also possible to use, as hydraulic fluid (27), other organic liquids which are also environmentally friendly, such as alcohol for example.

An opening (7*a*) with a connection possibility (7) is located at the lower end of the plunger pistons (4), and another opening (8*a*) with a connection possibility (8) is in each case located on the cylinder tubes (3). These openings (7*a*, 8*a*) have connection possibilities (7, 8) for pipes or hoses.

Depending on the safety standards to be met in the individual countries, different embodiments exist for double-ram lifting platforms of this type: some with a common hydraulic valve (9) for both lifting units (18) and some with two hydraulic valves. There are also embodiments with mechanical anti-lowering means (10) and without mechanical anti-lowering means (10). The embodiment with one hydraulic valve (9) and with mechanical anti-lowering means (10) is shown.

However, it is still the case that at least one of the two hydraulic lines (11) or (12) has to be designed to be movable either between hydraulic valve (9) and supporting piston (3) or between hydraulic valve (9) and plunger piston (4). The interiors of the plunger pistons (4) act virtually as an intermediate fluid container and store the necessary amount of fluid which is required to operate the lifting platform. In the case shown, the lifting platform is actuated via a lift control system (13) according to the dead-man principle. Another possibility would be actuation via hand or foot controls.

In the lifting function (13.1), compressed air flows through the line (28) and the curved tube (6) into the upper region (22) of the plunger piston (4) and acts on the surface of the hydraulic fluid (27.1) with compressed air. At the same time, the hydraulic valve or valves (9) between plunger piston (4) and cylinder tube (3) is/are opened, so that the hydraulic fluid (27) can flow into the interiors of the cylinder tubes (3) and the cylinder tubes (3) extend (17).

In the lowering function (13.2), the compressed air (26) flows out of the interiors of the plunger pistons (4) and the hydraulic fluid (27) loses the effect of the pressure of the compressed air (26). When the hydraulic valve or valves (9) is/are opened, the hydraulic fluid (27) flows back into the interiors of the plunger pistons (4) and the cylinder tubes (3) retract (17). The hydraulic fluid (27) circulates always within a closed circuit between the interiors of the plunger pistons (4) and the interiors of the cylinder tubes (3). In order to reduce the noise of air during the lowering operation (13.2) at the site of actuation, that is to say at the control point in the workshop, the discharged air can be fed back into the installation bay (1) via a further line (14) and a sound absorber (29). At the same time, this vents and aerates the installation bay (1).

In another embodiment (not shown), the pressurized discharged air can be at least partially fed to a pneumatic accumulator during the lowering operation, said accumulator in turn being able to make this stored compressed air available again during the next lifting operation.

In yet another embodiment (also not shown), the pressurized discharged air can be at least partially made available to the pressure generator as intake air, so that the latter can generate its compressed air not with atmospheric air, but rather at least partially with compressed air, that is to say air that has already been pressurized.

In the zero position (13.3) of the lift control system (13), all paths are closed. The lifting platform does not move.

If a mechanical anti-lowering means (10) is installed, during the lowering operation (13.2) the unlocking cylinder (16) of the anti-lowering means (10) is actuated at the same time in parallel with the pneumatic actuation of the hydraulic valve or valves (9) through the line (15). The unlocking cylinder (16) comprises a pressure spring (16.1) which pushes the claw of the anti-lowering means (10.1) into the notches (10.2) of the notched bar (10.3). During the lowering operation, the unlocking cylinder (16) is subjected to pressure, the pressure spring (16.1) is compressed and the claw of the anti-lowering means (10.1) moves out of the notches (10.2) of the notched bar (10.3). The lifting platform is able to move downwards.

During the lifting operation, the claw of the anti-lowering means (10.1) slides over the notches (10.2) of the notched bar (10.3) on account of its geometric shape.

Figure 2:
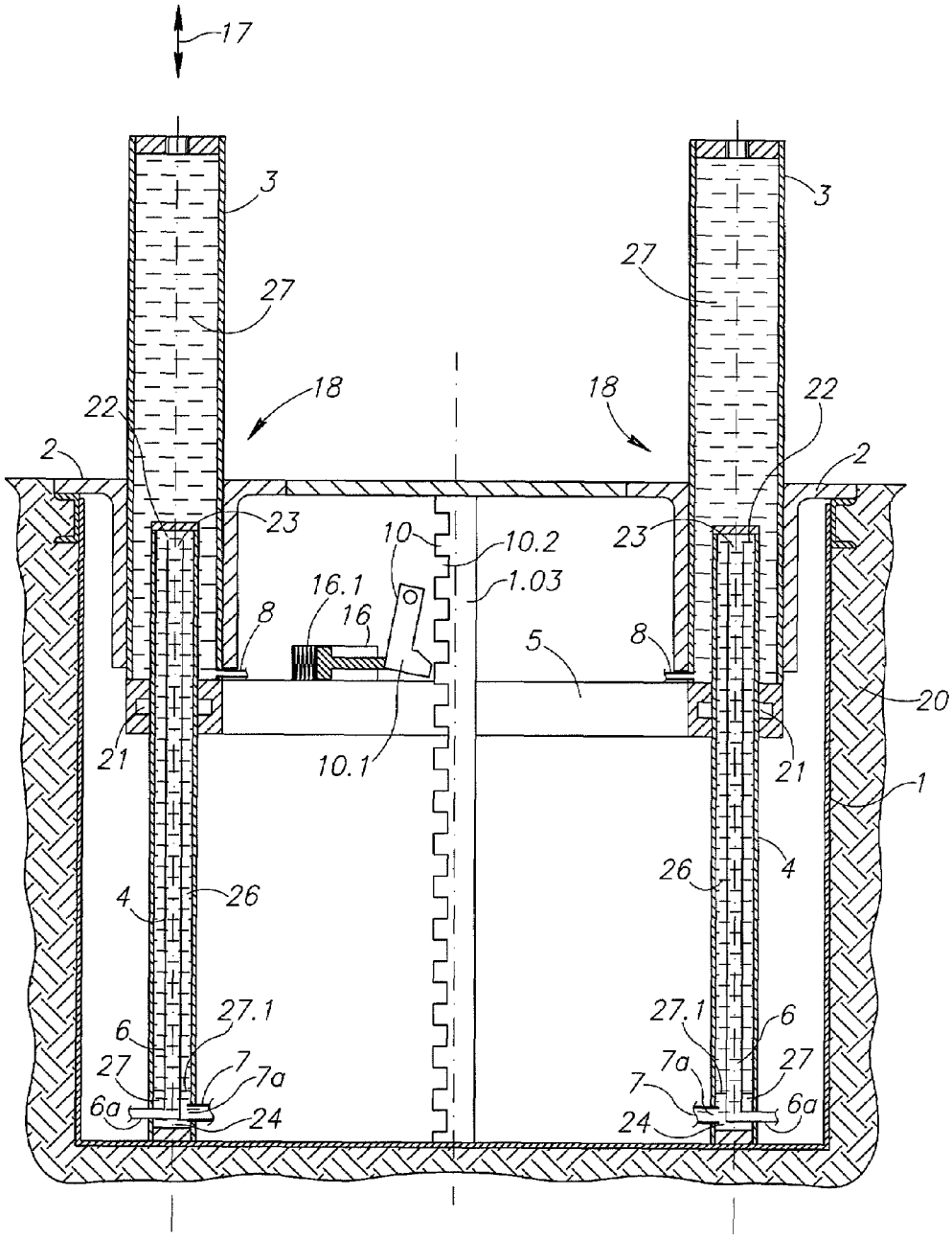
FIG. 2 shows a schematic, partially cut-away view of the lifting platform according to the invention in the extended state.
Figure 3:
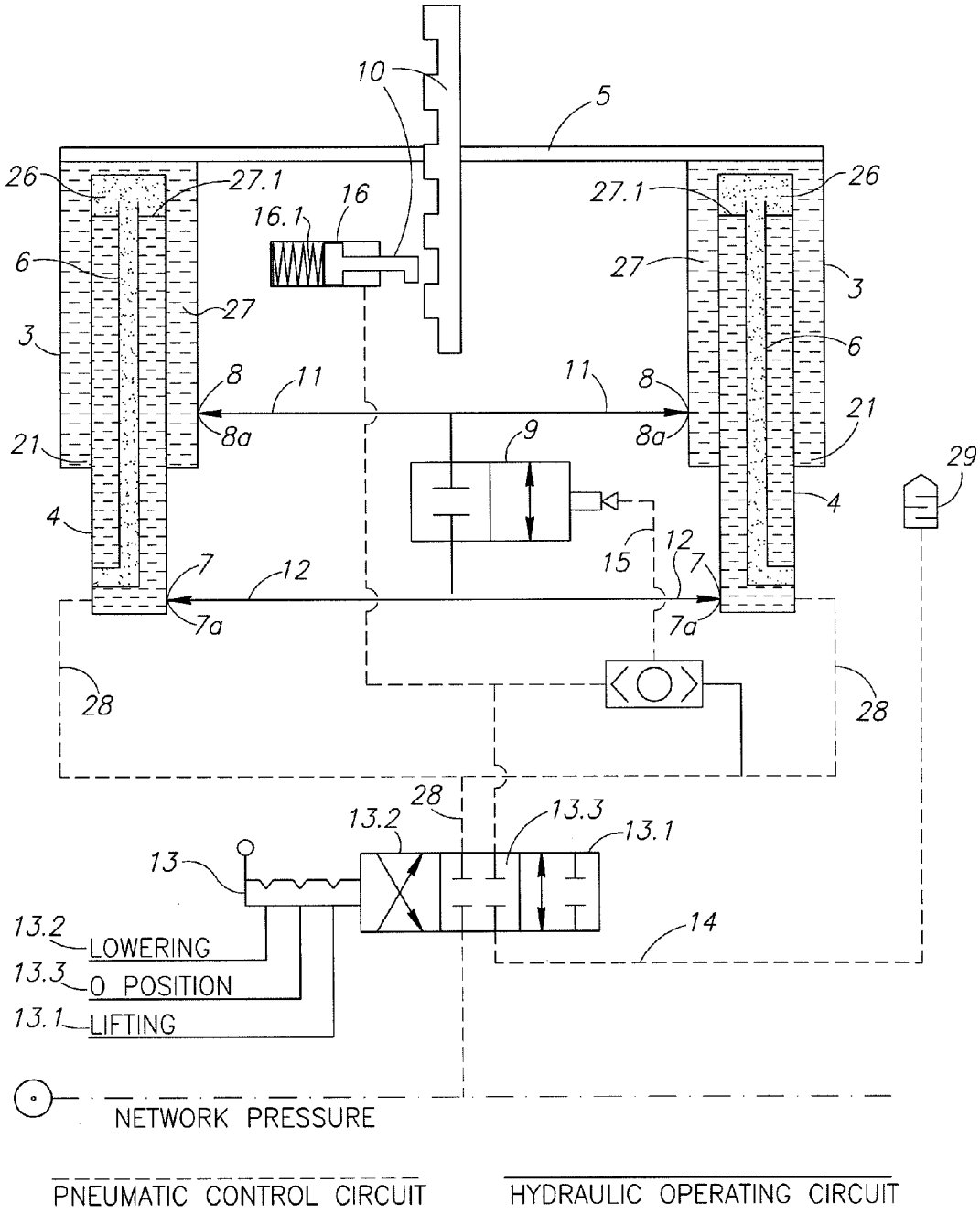
FIG. 3 shows a schematic circuit diagram of the pneumatic, hydraulic and mechanical functions.

The anti-lowering means (10) is shown in the latched-in state in FIG. 1, in the unlocked state in FIG. 2 and symbolically in FIG. 3.

ADVANTAGES OF THE INVENTION

The advantages of this invention are that, based on the known prior art, a double-ram lifting platform is provided which does not require a dedicated electrical connection and is also environmentally friendly since it does not require any oil as hydraulic fluid. It is operated with an environmentally friendly fluid, preferably with water. There are no longer any requirements to check and monitor the installation bay.

All the components of the lifting platform, apart from the lifting platform control panel, are located within the installation bay. This means that no pipes or hoses which carry fluid are located outside the installation bay. Another advantage is the low space requirement of the lifting platform in terms of both the size of the installation bay and the visible parts.

Furthermore, the proven principle and advantages of the two-way cylinder are retained. The fact that the two extending cylinder tubes are coupled at their lower end by means of a transverse support means both that the individual cylinder tubes cannot rotate about their longitudinal axis and that the two lifting units are synchronized in a simple manner.

These advantages mentioned in the last paragraph were previously known only in connection with an electrohydraulic drive and oil as hydraulic fluid.

Another advantage is that the compressed air compressor which is present in any motor vehicle workshop is better utilized as the compressed air supply unit and no further drive unit is required.

Since the compressed air can be stored in the vessel of the compressor, a lower electrical connection value is sufficient. The power required for a lifting operation no longer has to be provided within the lifting time of the lifting platform. This is especially advantageous in areas which have only a single-phase power supply and relatively low voltages.

Another advantage is the simple installation. The installation personnel do not require any electrical knowledge, and there is also no need for any electrical specialists for electrical commissioning.

Since no electrical power is required, this lifting platform is highly unsusceptible to faults. There is usually a high level of air humidity in the installation bay, which may lead to faults on electrical components over longer time periods. The pneumatic drive and control power ensures high functional reliability and a long service life.

The incorporation of a pneumatic accumulator or the return of the pressurized discharged air to the pressure generator and the associated use of the pressurized discharged air for the next lifting operation reduces the power requirement of the lifting platform.

LIST OF THE REFERENCES

1 installation bay
2 guide
3 cylinder tube
4 plunger piston
5 transverse support
6 curved tube
6*a* opening
7 connection possibility
7*a* opening
8 connection possibility
8*a* opening
9 hydraulic valve
10 mechanical anti-lowering means
10.1 claw of the anti-lowering means
10.2 notch
10.3 notched bar
11 hydraulic line
12 hydraulic line
13 lift control system
13.1 lifting position
13.2 lowering position
13.3 zero position
14 line
15 line
16 unlocking cylinder
16.1 pressure spring
17 vertical direction of the upward and downward movement
18 lifting unit
19 sides of the installation bay
20 earth, sand, gravel, lean concrete
21 seal at the lower end of the cylinder tube
22 upper region of the plunger piston
23 upper opening of the tube (6)
24 lower end of the plunger piston
25 lower end of the cylinder tube
26 compressed air
27 hydraulic fluid
27.1 surface of the hydraulic fluid
28 line
29 sound absorber

The invention claimed is:

1. A lifting device comprising:

two cylinder tubes for moving synchronously with one another vertically; each cylinder tube comprising a hydraulically operated lifting unit and an internal seal at its lower end;

a mechanical transverse support attached to the two lifting units for ensuring the synchronization of the two cylinder tubes and for preventing the two cylinder tubes from rotating about their longitudinal axis; and a mechanical anti-lowering means for preventing unintentional lowering in the event of a pressure loss;

wherein each lifting unit includes a stationary, hollow plunger piston having a cavity that is supported at a base, the piston includes a tube within the piston cavity that extends from a point near a first end to a second end of the piston, the piston tube includes an opening located near the second end of the piston, the piston tube receives compressed air and the cavity within the piston external to the piston tube receives hydraulic fluid, wherein the plunger pistons include at the first end of the plunger pistons a first opening for receiving compressed air into the piston tube and a second opening for allowing the flow of the hydraulic fluid.

2. The device of claim 1, wherein the hydraulic fluid is at least one of water, an aqueous liquid or some other organic liquid.

3. The device of claim 1, further comprising a first hose for connecting the two first openings of the plunger pistons and a second hose for connecting the two second openings of the plunger pistons.

4. The device of claim 1, wherein the hydraulic fluid flows between the cavities of the plunger pistons and cavities of the cylinder tubes.

5. The device of claim 1, further comprising a sound absorber for receiving air flowing out of the piston tubes during a lowering operation.

6. The device of claim 1, wherein the surface of the hydraulic fluid in the plunger pistons in a retracted state is located near the opening of the piston tube near the second end.

* * * * *